US007493060B2

(12) United States Patent
Sekovski et al.

(10) Patent No.: US 7,493,060 B2
(45) Date of Patent: Feb. 17, 2009

(54) CLEANING SYSTEM FOR REMOVING DENDRITES FROM A CHARGING DEVICE IN A XEROGRAPHIC PRINTER

(75) Inventors: David Sekovski, Rochester, NY (US); Robert A. Gross, Penfield, NY (US); John D. McCaffrey, Rochester, NY (US); Michael N. Soures, Webster, NY (US); David K. Ahl, Rochester, NY (US); Douglas A. McKeown, Geneseo, NY (US); Michael G. Petranto, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 260 days.

(21) Appl. No.: 11/228,629

(22) Filed: Sep. 16, 2005

(65) Prior Publication Data

US 2007/0065172 A1 Mar. 22, 2007

(51) Int. Cl.
*G03G 15/02* (2006.01)

(52) U.S. Cl. ..... 399/100

(58) Field of Classification Search ..... 399/100
See application file for complete search history.

(56) References Cited

U.S. PATENT DOCUMENTS

| | | | | |
|---|---|---|---|---|
| 4,566,777 | A * | 1/1986 | Honda et al. | 399/100 |
| 4,811,050 | A * | 3/1989 | Tanjo et al. | 399/100 |
| 5,485,255 | A | 1/1996 | Reuschle et al. | |
| 5,532,798 | A * | 7/1996 | Nakagami et al. | 399/170 |
| 6,381,427 | B1 * | 4/2002 | Bertram et al. | 399/101 |
| 6,449,447 | B1 | 9/2002 | Regelsberger et al. | |
| 2003/0231896 | A1 * | 12/2003 | Kikuchi | 399/100 |

* cited by examiner

*Primary Examiner*—David M Gray
*Assistant Examiner*—Joseph S. Wong
(74) *Attorney, Agent, or Firm*—R. Hutter

(57) ABSTRACT

In a xerographic printing apparatus, a charge device is used to apply a charge to a photoreceptor. The charge device includes a wire. A shuttle moves along the charge device, and includes a brush wherein the sides of the bristles contact the wire. When the brush moves along the wire, an accumulation of stray particles on the wire is made relatively smooth.

3 Claims, 3 Drawing Sheets

CLEANING SYSTEM FOR REMOVING DENDRITES FROM A CHARGING DEVICE IN A XEROGRAPHIC PRINTER

CROSS-REFERENCE TO RELATED APPLICATION

Cross-reference is hereby made to the following patent application, being filed simultaneously herewith: CLEANING SYSTEM FOR A CHARGING DEVICE IN A XEROGRAPHIC PRINTER, U.S. Ser. No. 11/228,898, Publication No. 20070065173, published Sep. 16, 2005.

TECHNICAL FIELD

The present disclosure relates to a xerographic printing apparatus, and specifically to a mechanism for cleaning a charging device associated with the apparatus.

BACKGROUND

In the well-known process of electrostatographic or xerographic printing, an electrostatic latent image is formed on a charge-retentive imaging surface, and then developed with an application of toner particles. The toner particles adhere electrostatically to the suitably-charged portions of the imaging surface. The toner particles are then transferred, by the application of electric charge, to a print sheet, forming the desired image on the print sheet. An electric charge can also be used to separate or "detack" the print sheet from the imaging surface.

For the initial charging, transfer, or detack of an imaging surface, the most typical device for applying a predetermined charge to the imaging surface is a "corotron," of which there are any number of variants, such as the scorotron or dicorotron. Common to most types of corotron is a bare conductor, in proximity to the imaging surface, which is electrically biased and thereby supplies ions for charging the imaging surface. The conductor typically comprises one or more wires (often called a "corona wire") and/or a metal bar forming saw-teeth, the conductor extending parallel to the imaging surface and along a direction perpendicular to a direction of motion of the imaging surface. Other structures, such as a screen, conductive shield and/or nonconductive housing, are typically present in a charging device, and some of these may be electrically biased as well. The corotron will have different design parameters depending on whether it is being used for initial charging, transfer, or detack.

In a practical application of charging devices, dust and other debris may collect in or around the corotron. Clearly, the presence of such material will adversely affect the performance of the corotron, and may cause dangerous arcing conditions. Therefore periodic cleaning of the charging device is often desired, and many schemes exist in the prior art for cleaning the charging device, such as by wiping the corona wire. In high-end printing machines, this wiping may be performed by a motorized wiper that travels along the corotron wire.

U.S. Pat. No. 5,485,255 discloses a wiping mechanism for cleaning a corona wire as well as a scorotron screen, which employs a lead screw.

U.S. Pat. No. 6,449,447 discloses a control system for a wiping mechanism for cleaning a corona wire, in which the wiping process is initiated when arcing conditions are detected in the charge device.

SUMMARY

According to one aspect, there is provided an apparatus useful in electrostatographic printing. A charge device, including a wire extending along an extension direction, places a charge on an imaging surface. A shuttle, movable along the extension direction, includes at least one brush including a plurality of bristles, the bristles defining sides contacting the wire. When the shuttle is moved in the extension direction, the brushes promote a substantially uniform layer of accumulated material on the wire.

DETAILED DESCRIPTION

Figure 1:
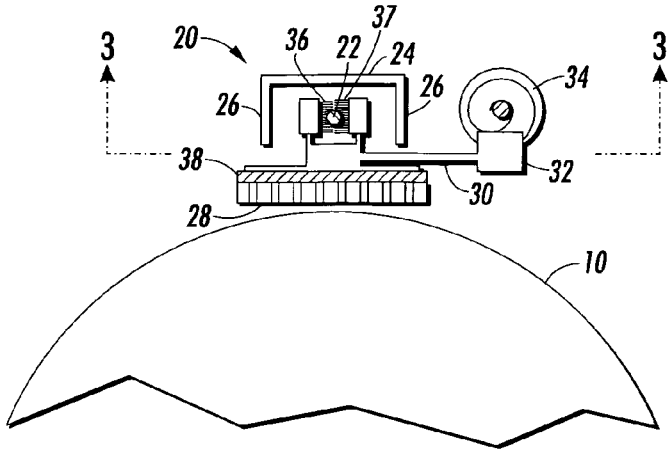
FIG. 1 is an elevational view of a charging device associated with an Imaging surface.

FIG. 1 is an elevational view of a charging device associated with an imaging surface. The imaging surface is shown as formed by a drum photoreceptor 10, although belt photoreceptors and other charge receptors (such as intermediate belts, as used in color printing) are common as well. Disposed near the photoreceptor 10 is a charge device generally indicated as 20, which, depending on a larger context, may be for initial charging, transfer, or detack in a printing process. As mentioned above, charge devices, such as corotrons, scorotrons, dicorotrons, etc., have many design variants, but typically include one or more corona wires such as 22, a conductive shield and/or nonconductive housing 24 including sidewalls such as 26, as well as a screen 28; each of these elements may be biased as required for a particular purpose. As shown, wire 22 extends parallel to the imaging surface formed by photoreceptor 10, and in an "extension direction" perpendicular to a direction of rotation or motion of photoreceptor 10.

Figure 2:
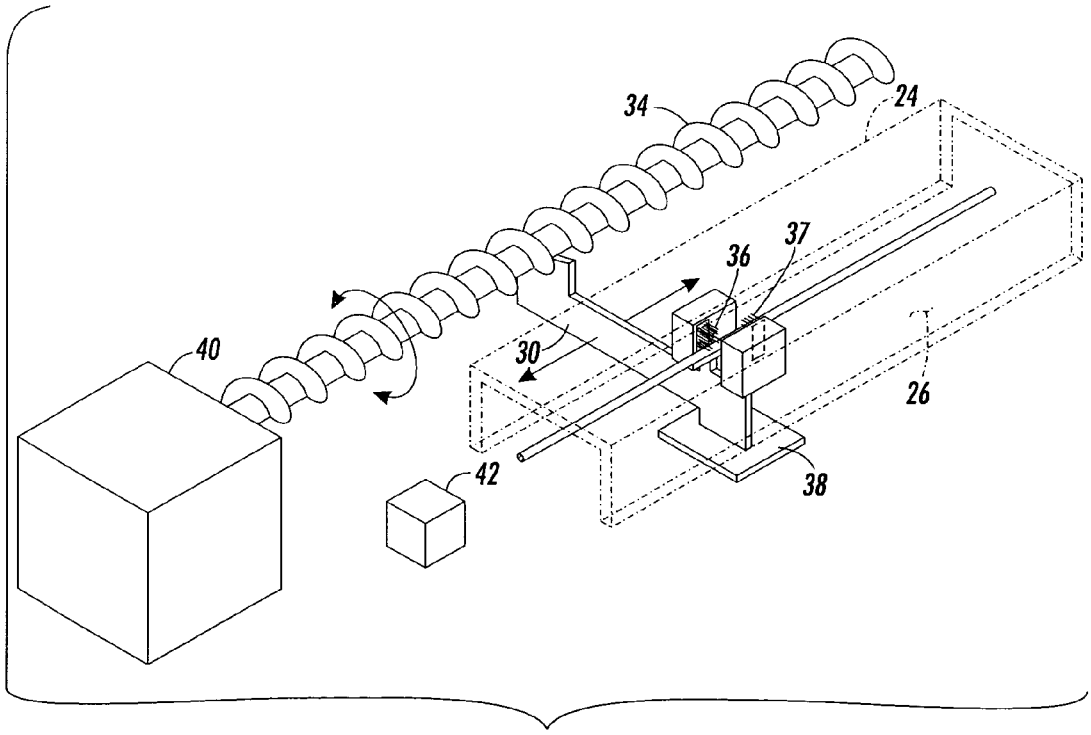
FIG. 2 is a perspective view showing, in isolation, essential parts of the wiping mechanism for a charging device.

When it is desired to clean wire 22, or screen 28, there is provided what is here generally called a "shuttle" 30. With further reference to FIG. 2, shuttle 30 is a piece which includes a tooth 32 which interacts with the windings of a lead screw 34; shuttle 30 further includes brushes 36, 37 for cleaning wire 22, as will be described in detail below, and wiper 38 which cleans screen 28.

As can be seen in FIG. 2, shuttle 30 interacts with lead screw 34 so that, when lead screw 34 is rotated in a particular direction, the shuttle 30 travels along the lead screw, whereby a wiper such as 36 or 38 can wipe or clean the wire 22 and screen 28. The lead screw 34 is here rotated by a motor 40, which can rotate the lead screw in either direction. (In a practical embodiment, there may also be any number of guide rails or other surfaces, not shown, to facilitate proper motion of the shuttle 30.) Although the present embodiment includes a lead screw, other mechanisms for moving the shuttle 30 can be used, such as a linear motor, or other mechanisms for converting the rotational motion of a motor such as 40 to linear motion, such mechanisms including pulleys, belts, racks, etc.

Figure 3:
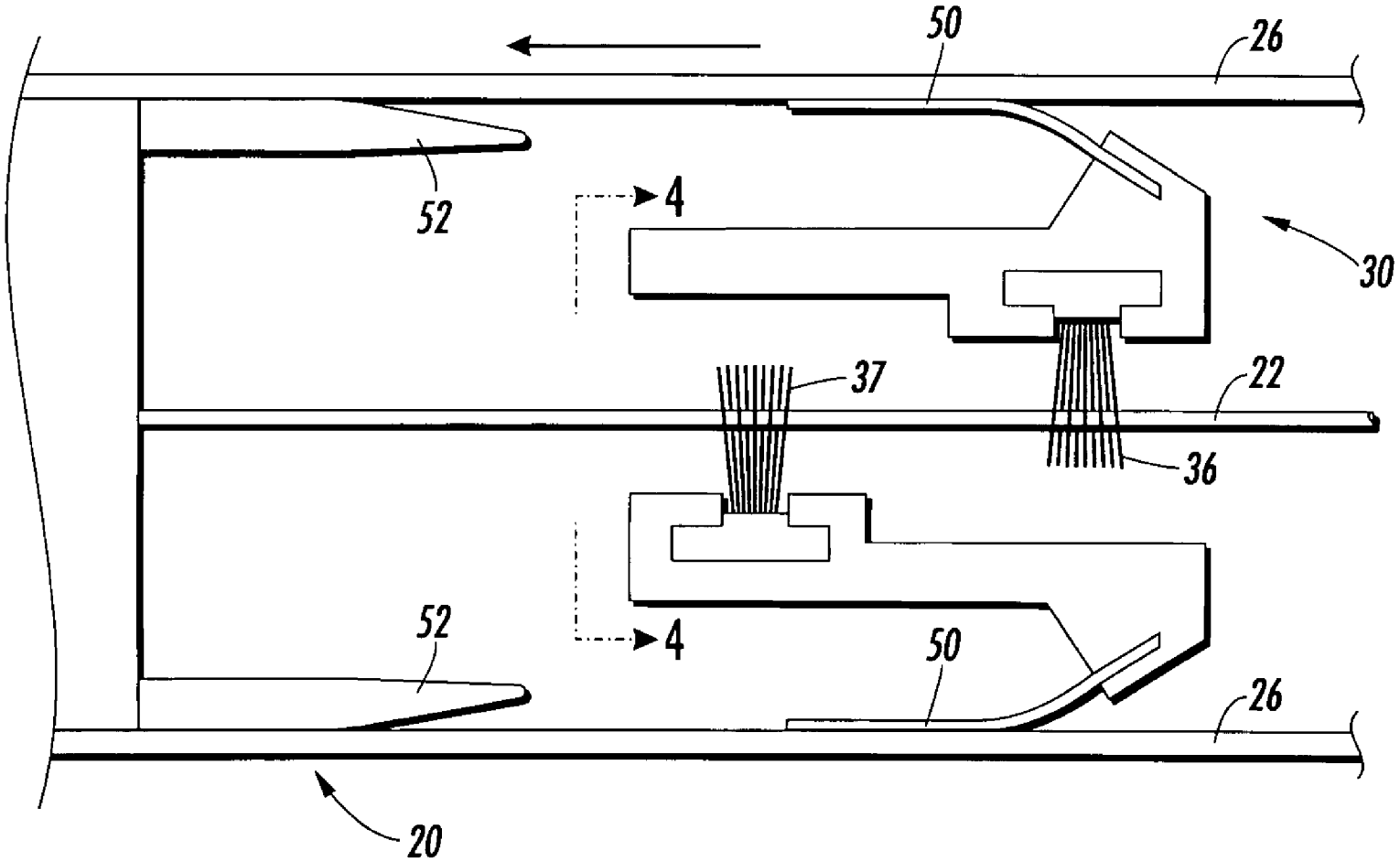
FIG. 3 is a plan view, such as shown by arrow 3 in FIG. 1, of a shuttle movable within a housing of a charge device.

FIG. 3 is a plan view, such as shown by arrow 3 in FIG. 1, of a shuttle 30 movable within housing 24 of charge device 20 (only a portion of the entire length of charge device 20 is shown). Disposed on the shuttle 30 and moveable therewith are two scrapers, each indicated as 50. Each scraper 50 contacts a portion of the inner surface of an adjacent sidewall 26. In one embodiment, each scraper 50 is largely made of a flexible material, such as Mylar® or of a thin strip of metal such as copper and is mounted on shuttle 30 to exhibit a natural resiliency, causing the scraper 50 to be urged against sidewall 26. When shuttle 30 is moved along the length of charge device 20, each scraper 50 scrapes residual toner and any other material from the inner surface of sidewall 26.

Figure 4:
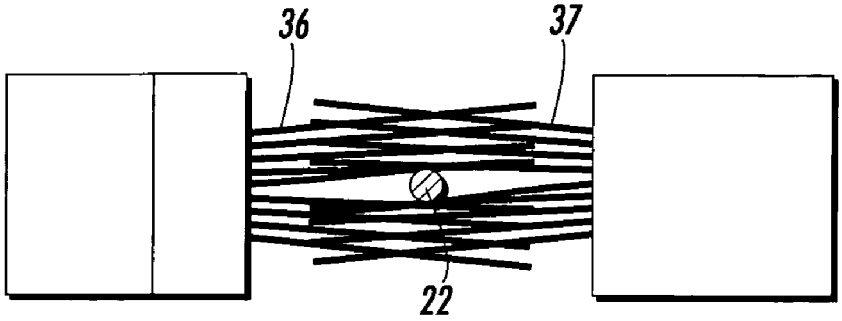
FIG. 4 is an elevational view through line 4-4 in FIG. 3.

FIG. 4 is an elevational view through line 4-4 in FIG. 3, showing how each brush 36, 37 contacts, on the sides (as opposed to the ends) of some of the bristles thereof, a portion of the surface of wire 22. Although it is known in the prior art to use a brush to wipe a flat surface, such as the side of a member forming a pin array, in a charging device, the use of brushes to clean a wire presents unique advantages.

Figure 5:
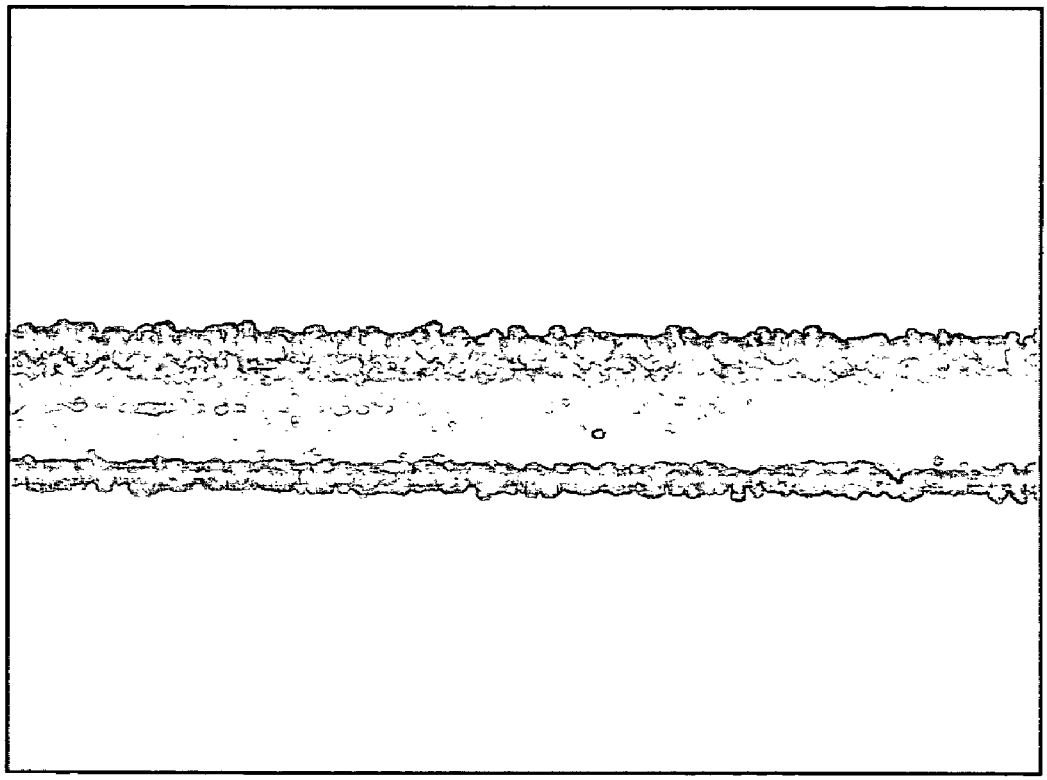
FIG. 5 is a photomicrograph of a portion of corotron wire that has undergone a certain amount of use.

FIG. 5 is a photomicrograph of a portion of corotron wire such as 22, which has undergone a certain amount of use. As can be seen, with use in a printer, the wire attracts stray materials such as airborne dirt and airborne droplets of oil. When these stray materials accumulate on the wire 22, the materials, such as oxides, form a non-smooth surface coating on the wire 22, in particular a surface characterized by "fuzz" and/or distinct "dendrites" which grow with further use of the wire in the relatively dirty airborne environment within a xerographic printer.

The use of the sides of bristles of brushes to clean or otherwise affect the surfaces of a corona wire 22 disturbs the growth of dendrites on the corona wire, which promotes a relatively uniform surface of accumulated material on the wire. In contrast, the use of a foam material on the shuttle, which is common in the prior art, has the object of actually removing accumulated material from the wire surface. In some practical situations, the maintenance of a fairly uniform layer of accumulated material on the wire results in a longer life (as opposed to periodically removing the layer) of the wire before replacement of the wire is mandated.

In one practical embodiment, the brushes 36, 37 are made of natural monofilament polypropylene having a fiber diameter of 0.007 inch (0.18 mm) and a fiber density of 125 ends per inch. Each brush is ultrasonically welded to its backing to withstand a pullout force of 22 newtons.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method of cleaning a charge device for placing a charge on an imaging surface in electrostatographic printing, the charging device defining at least one wire extending in a cross-process direction, comprising:

moving a shuttle movable along the cross-process direction, the shuttle having predetermined properties to disturb dendrites on the wire and leave a substantially uniform layer of accumulated material on the wire, the shuttle including at least one brush including a plurality of bristles, the sides of the bristles contacting the wire, the bristles substantially including monofilament polypropylene having a fiber diameter of about 0.007 inch and a fiber density of about 125 ends per inch.

2. The method of claim 1, the moving of the shuttle being performed with a lead screw.

3. The method of claim 1, the device performing one of charging, cleaning, or image transfer relative to the imaging surface.

* * * * *